US008982673B2

(12) United States Patent
Goeller et al.

(10) Patent No.: US 8,982,673 B2
(45) Date of Patent: Mar. 17, 2015

(54) CALENDAR MECHANISM INCLUDING A QUICK MONTH CORRECTOR

(75) Inventors: Eric Goeller, Les Hopitaux Vieux (FR); Alain Zaugg, Le Sentier (CH)

(73) Assignee: Montres Breguet S.A., l'Abbaye (CH)

( * ) Notice: Subject to any disclaimer, the term of this patent is extended or adjusted under 35 U.S.C. 154(b) by 26 days.

(21) Appl. No.: 13/424,843

(22) Filed: Mar. 20, 2012

(65) Prior Publication Data

US 2012/0243381 A1 Sep. 27, 2012

(30) Foreign Application Priority Data

Mar. 22, 2011 (EP) ..... 11159240

(51) Int. Cl.
*G04B 27/00* (2006.01)
*G04B 19/24* (2006.01)
*G04B 19/25* (2006.01)

(52) U.S. Cl.
CPC ..... *G04B 19/25* (2013.01); *G04B 27/005* (2013.01)
USPC ..... 368/34; 368/28

(58) Field of Classification Search
USPC ..... 368/28, 31–38
See application file for complete search history.

(56) References Cited

U.S. PATENT DOCUMENTS

| | | | | |
|---|---|---|---|---|
| 212,882 | A * | 3/1879 | Baillot | 368/28 |
| 3,673,789 | A * | 7/1972 | Tsuzuki et al. | 368/37 |
| 4,234,943 | A * | 11/1980 | Teramoto et al. | 368/35 |
| 4,291,397 | A * | 9/1981 | Wuthrich et al. | 368/35 |
| 4,432,081 | A * | 2/1984 | Schwartz et al. | 368/35 |
| 7,139,224 | B2 * | 11/2006 | Schneider | 368/28 |
| 7,218,576 | B1 * | 5/2007 | Bron | 368/35 |
| 7,333,397 | B2 * | 2/2008 | Crettex | 368/28 |
| 2006/0221773 | A1 * | 10/2006 | Kuepfer et al. | 368/37 |
| 2007/0109916 | A1 | 5/2007 | Bron | |
| 2012/0106302 | A1 * | 5/2012 | Philippine | 368/35 |

FOREIGN PATENT DOCUMENTS

| | | | |
|---|---|---|---|
| CH | 691 149 | A5 | 4/2001 |
| CH | 698 748 | B1 | 10/2009 |
| EP | 1 004 947 | A2 | 5/2000 |
| EP | 1 785 783 | A1 | 5/2007 |
| GB | 2 011 663 | A | 7/1979 |

OTHER PUBLICATIONS

U.S. Appl. No. 13/735,118, filed Jan. 7, 2013, Zaugg.
European Search Report issued Oct. 10, 2011, in Euro Patent Application No. EP 11 15 9240, filed Mar. 22, 2011, (with English translation).

* cited by examiner

*Primary Examiner* — Amy Cohen Johnson
*Assistant Examiner* — Daniel Wicklund
(74) *Attorney, Agent, or Firm* — Oblon, McClellend, Maier & Neustadt, L.L.P.

(57) ABSTRACT

The calendar mechanism includes a 31 wheel set (31) for controlling a date indicator, a date drive means for driving the 31 wheel set, a 12 wheel set (12) for controlling a month indicator, and a monthly drive means for driving the 12 wheel set at the end of each month. The monthly drive means is activated by the 31 wheel set during the change from the end of one month to the first day of the next month. The calendar mechanism further includes a manually activated month corrector device arranged to advance the 31 wheel set in one stroke to an angular position corresponding to the indication of the first day of the next month, so that the monthly drive means, activated by the change from one month to the next, increments the 12 wheel set by one step.

13 Claims, 3 Drawing Sheets

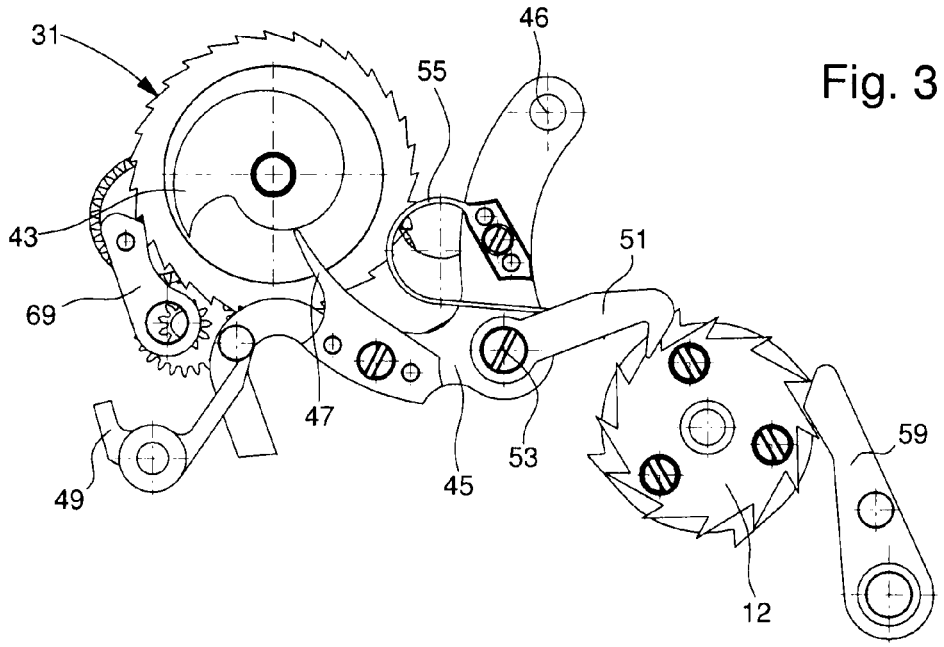
Fig. 3
Fig. 4
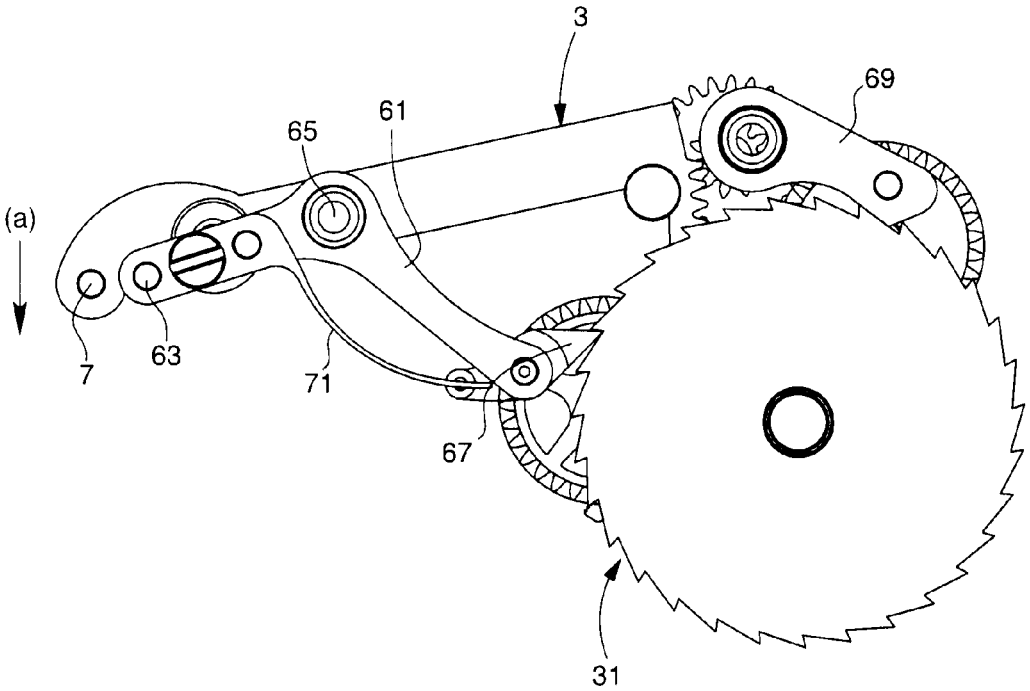

CALENDAR MECHANISM INCLUDING A QUICK MONTH CORRECTOR

This application claims priority from European Patent Application No. 11159240.8 filed Mar. 22, 2011, the entire disclosure of which is incorporated herein by reference.

FIELD OF THE INVENTION

The present invention concerns a calendar mechanism for a timepiece and more specifically a mechanism of this type including a date display, a month display and a quick month corrector.

PRIOR ART

Calendar mechanisms for timepieces are common. CH Patent No 697,662, in particular, discloses a calendar mechanism for a timepiece. This mechanism is more specifically a perpetual date mechanism. It comprises in particular a date display and a month display. The mechanism disclosed in this prior art document also comprises a date corrector and a month corrector for manually correcting the indication of the date and the month respectively. These correctors are arranged to be actuated by two respective push-buttons for incrementing by one step the date indication and the month indication respectively. According to the aforementioned prior art document, one of the advantages of the mechanism disclosed is that it can move the month indication forward using the corrector provided for this purpose, without affecting the date indication. In most cases, this arrangement makes setting the date of the calendar more intuitive. However, this is not always the case. For example, if the month corrector is actuated while the calendar indicates 30th January, the calendar changes to the 30th February.

Moreover, as explained in EP Patent No 0 509 959, when the same timepiece combines an equation of time mechanism and a calendar mechanism, it is advantageous to drive the equation of time cam from the 31 wheel set. Indeed, owing to this arrangement, it is theoretically possible to automatically return the equation of time cam to its exact position after an indefinite period where the movement is stopped, simply by resetting the calendar to the date. However, it will be clear that calendar mechanisms which include a corrector for modifying the month indication without affecting the angular position of the 31 wheel set do not have this advantage. Indeed, in this case, the month correction does not affect the angular position of the equation of time cam either.

EP Patent No. 1 004 947 discloses a quick date correction mechanism comprising an operating member which is accessible from the exterior of the watch and arranged for driving the date star wheel in rotation via a gear train. In certain embodiments, the multiplication ratio of the gear train is sufficient for one movement of the operating member to drive the date star wheel by a value of more than one month. However, under these conditions, the high multiplication ratio makes the correction device more imprecise. It thus becomes very difficult for the user to release the operating member in proximity to the desired date without risking going past said date.

BRIEF SUMMARY OF THE INVENTION

It is an object of the present invention to overcome the aforementioned drawbacks. This object is achieved by providing a calendar mechanism in accordance with the annexed claim 1.

According to the present invention, the stop mechanism can either occupy an inactive position, in which it does not intercept the trajectory of the rotating stop member, or an active position in which it locks the 31 wheel set in an angular position corresponding to the indication of the first day of the month. Owing to this feature, the quick corrector device according to the invention does not interfere with the normal operation of the date drive means. It will also be clear that, when the 31 wheel set moves forward to the first day of the next month in one stroke, it actuates, in passing, the monthly drive means, which causes the 12 wheel set and the month indicator to move forward one step. In other words, according to the present invention, quick correction of the month indication is accompanied by a quick advance of the date to the next month. The connection between the date and the month is thus preserved during correction. This feature is particularly advantageous where the calendar mechanism is provided for cooperating with an equation of time mechanism, the 31 wheel set then being arranged to drive the equation of time cam. Indeed, in this case, the month corrector device according to the invention simultaneously corrects the angular position of the equation of time cam.

BRIEF DESCRIPTION OF THE DRAWINGS

Other features and advantages of the invention will appear upon reading the following description, given solely by way of non-limiting example, with reference to the annexed drawings, in which:

FIG. 3 is a partial bottom view (from the dial side) of the calendar mechanism of FIGS. 1 and 2, more specifically showing the monthly drive means.

FIG. 4 is a partial bottom view of the calendar mechanism of FIGS. 1, 2 and 3, more specifically showing the date corrector.

DETAILED DESCRIPTION OF TWO EMBODIMENTS

The watch and the timepiece movement that it contains will not be described hereinafter in their entirety, but only the calendar mechanism. As regards the timepiece movement, it is sufficient to specify that it is arranged to drive, via date drive means forming part of the calendar mechanism, a 31 wheel set at a rate of one revolution per month. The 31 wheel set in turn actuates a date indicator hand.

Figure 1:
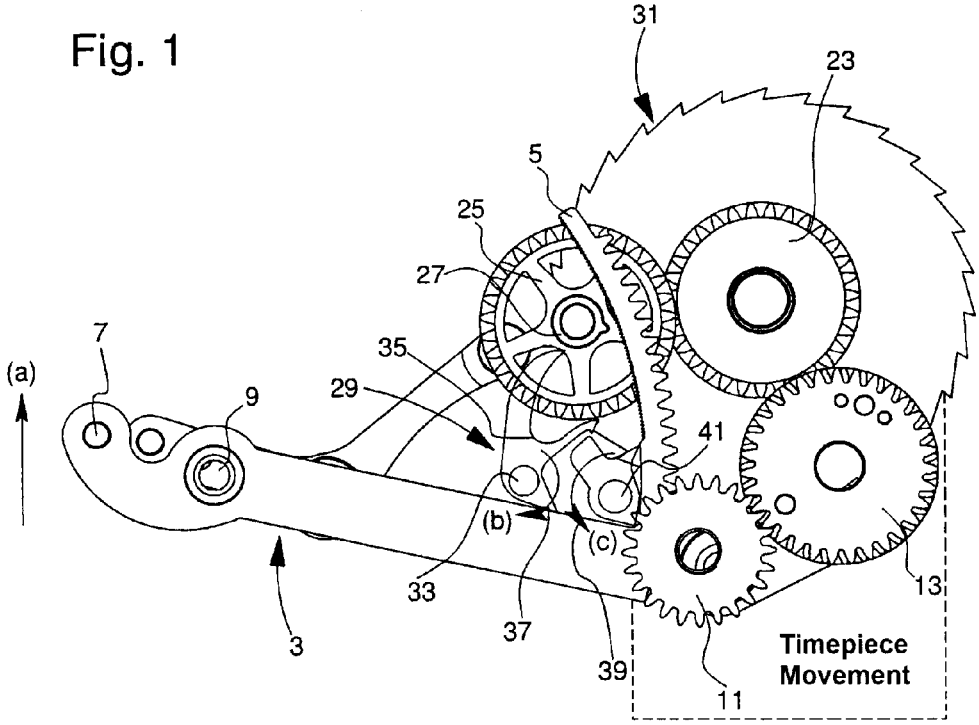
FIG. 1 is a partial top view (from the bridge side) of a first embodiment of the calendar mechanism of the invention, more specifically showing the quick corrector.
Figure 2:
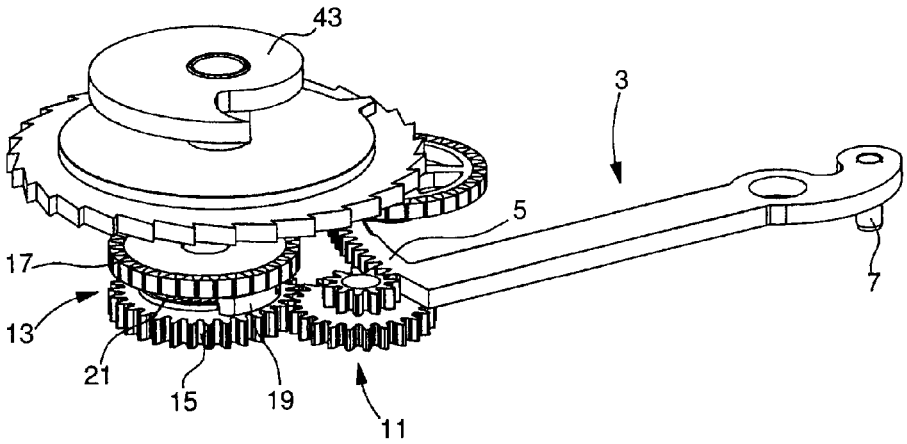
FIG. 2 is a partial perspective view of the calendar mechanism and particularly the quick corrector of FIG. 1.

Referring first of all to FIG. 1, it is seen that the quick month corrector includes a rack 3 with a toothed sector 5 at one end thereof and a first control pin 7 at the other end. The rack is pivotally mounted about an axis 9 arranged close to the end carrying pin 7. The toothed sector meshes with the pinion of a first wheel set 11, and the wheel of said first wheel set meshes with a single direction gear train 13. As can be seen in the perspective view of FIG. 2, the single direction gear train includes an input wheel 15 and an output wheel 17, which are coaxial and can pivot in relation to each other. The output wheel 17 carries a coaxial ratchet (not shown) which is sandwiched between the input wheel and the output wheel. A click 19 is pivoted on the plate of the input wheel 15. This click is returned against the periphery of the ratchet by a spring 21. Those skilled in the art will understand that the click is arranged to cooperate with a ratchet tooth when the input wheel rotates in the clockwise direction and to slide against the ratchet when the input wheel rotates in the anti-clockwise direction. Referring again to FIG. 1, it can be seen that the output wheel of the single direction gear train 13 meshes with a pinion 23 which forms part of the thirty-one wheel set (which is generally referenced 31).

The operation of the elements of the month corrector which have just been listed will now be described. The quick month corrector of the present example is to be actuated manually via a multi-function coaxial corrector device (not shown) which may advantageously be of the same type as that disclosed in EP Patent No 1 939 699 in the name of the Applicant. EP Patent No. 1 939 699 is incorporated herein by reference. It will be clear however that numerous other manual control devices known to those skilled in the art may also be suitable for actuating the quick month corrector of the present invention. In any event, this description does not provide details concerning the manual control device. Indeed, the features thereof do not have any direct bearing on the implementation of the invention.

When the person wearing the watch manually actuates the coaxial multi-function corrector button (not shown), the internal bearing surface of the control mechanism pushes the first control pin 7 in the direction of the arrow (a) (FIG. 1), which causes rack 3 to pivot about axis 9. The length of travel of the inner bearing surface of the control mechanism is considerably shorter than the length of toothed sector 5. However, since the pivot axis 9 is close to control pin 7, the lever effect allows the whole of the sector 5 toothing to cooperate with the pinion of wheel set 11. Wheel set 11 is thus driven anti-clockwise. Control pin 7 is returned by a spring (not shown) in the opposite direction to the arrow (a) of FIG. 1. Thus, when the person wearing the watch releases the pressure on the control mechanism button, and the inner bearing surface thereof returns to the rest position, rack 3 returns to its initial position, this time driving wheel set 11 clockwise.

When wheel set 11 is rotating anti-clockwise, it drives input wheel 15 of the single direction gear train 13 clockwise. Under these conditions, output wheel 17 rotates integrally with the input wheel and also rotates clockwise. When wheel set 11 moves backwards again clockwise, it drives the input wheel anti-clockwise. Under these conditions, the single direction gear train is uncoupled and the output wheel is not driven. Finally, as already stated, the output wheel meshes with the pinion 23 of the 31 wheel set. It is thus clear that the effect of the user actuating the multi-function coaxial corrector button is to drive the 31 wheel set anti-clockwise. The gear ratios are selected as a function of the length of travel of the control mechanism, so that a single application of pressure on the button is sufficient to advance the 31 wheel set through one complete revolution.

FIG. 1 also shows that pinion 23 of the 31 wheel set also meshes with a pierced wheel 25 which has five radial arms carrying a toothed felloe. It will be noted that, in this example, the toothing of the felloe of wheel 25 has the same number of teeth as pinion 23. Moreover, FIG. 1 also shows a lever 29 which is pivotally mounted about an axis 33 and which carries, at one end, a bifid hook 35, and at the other end, a beak 37. The shape of lever 29 is adapted to allow it to cooperate with a bolt 39 which is pivotally mounted on an axis 41. Lever 29 and bolt 39 are respectively returned in the direction of arrows (b) and (c) by two springs (not shown). As will be seen hereinafter, lever 29 and bolt 39 are both moveable between an inactive position and an active position. FIG. 1 further shows that the hub of wheel 25 carries a pin (or a stud) 27 in an off-centre position. Pin 27 is arranged to cooperate with hook 35 only when the hook is in an active position.

The function of the elements of the quick month corrector which have just been described is to stop the quick advance of the date wheel set as soon as the latter reaches the angular position corresponding to the indication of the first day of the month. The operation is as follows. While the quick month corrector is not being activated, rack 3 is in its rest position shown in FIG. 1. As can be seen, beak 37 of lever 29 is then in abutment against the rack. The rack resists the pivoting of the lever in the direction of the arrow (b) and keeps it in the inactive position. In this position, hook 35 is outside the circular trajectory of the pin 27. The hook therefore does not interfere with the rotation of the 31 wheel set. It will also be noted that bolt 39 is also in abutment against the rack. The rack thus also holds the bolt in the inactive position. When the quick month corrector is activated, the rack pivots, releasing lever 29 and bolt 39 which are then free to pivot respectively in the direction of the arrows (b) and (c) to change into the active position.

When lever 29 is in the active position, hook 35 acts as a stop arranged to intercept the trajectory of pin 27. When the stop mechanism is in the active position and the pin is driven in rotation by the quick month corrector, the latter abuts against the hook 35 which stops the travel thereof. Pin 27 thus plays the part of a rotating stop member which is arranged to cooperate with stop mechanism 25. It will also be clear that, owing to the is presence of bolt 39, it is impossible for the rotating stop member 27 to push stop mechanism 29 back into the inactive position. The collision of the rotating stop member with the stop mechanism thus has the effect of stopping the progress of the 31 wheel set. Lever 29 is also positioned relative to the pin so as to immobilise the 31 wheel set in the angular position corresponding to the indication of the first day of the month. Once the 31 wheel set has moved to the angular position corresponding to the indication of the first day of the month, rack 3 returns to its initial position pushing back lever 29 and bolt 39 which return to the inactive position. Those skilled in the art will understand from the preceding description that according to a variant of this embodiment, it would be possible to omit wheel 25. Pin 27 could in fact be mounted directly on the 31 wheel set. It is considerations of space which make it preferable to use an additional wheel (wheel 25).

In a known manner, the calendar mechanism of the invention includes a monthly drive means activated by the 31 wheel set for incrementing the month indication by one step at the end of every month. Referring now to FIG. 3, it can be seen that the monthly drive means includes an eccentric 43 which is secured to and concentric with the 31 wheel set, an instantaneous lever 45 pivotally mounted about an axis 46, a beak 47 integral with the instantaneous lever, an instantaneous lever spring 49 arranged to return the beak of the lever against the periphery of the eccentric, and an instantaneous click 51 pivoted on an axis 53 arranged in a bend in the lever, the click 51 being returned against the asymmetrical saw teeth of a ratchet toothing carried by the twelve wheel set by a spring 55 (the twelve wheel set is generally referenced 12). Finally, the monthly drive means also includes a jumper spring 59 arranged to cooperate with the ratchet toothing of the 12 wheel set.

The operation of the monthly drive means will now be explained. In this example, the shape of eccentric 43 is such that the start and the peak of the curve of the eccentric are superposed. Moreover, the eccentric is arranged such that the angular position of the 31 wheel set at the moment when beak 47 of the instantaneous lever 45 can fall without transition from the peak to the start of the curve of the eccentric approximately corresponds to the transition between the 31st day of a month and the first day of the next month. On the first day of a month, the beak is at the start of the curve. Next, the beak climbs the curve day after day, gradually lifting the instantaneous lever. The pivoting of the instantaneous lever has the effect of sliding click 51 against the ratchet toothing of the 12 wheel set. At the end of the month, beak 47 reaches the peak of the curve and, pushed by spring 49, suddenly drops to return to the start of the curve. In falling, the beak abruptly pushes the instantaneous lever and click 51 backwards. During its backward movement, click 51 hooks one of the saw teeth of the ratchet toothing and thus advances the 12 wheel set by one step, which has the effect of incrementing the date indication by one month. It will be noted that the monthly drive means that has just been described is arranged to increment the 12 wheel set each time that the 31 wheel set passes from the last day of one month to the first day of the next month. The monthly drive means is activated both when the 31 wheel set passes from one month to another driven by the movement, and when it is driven by the quick month corrector. Moreover, the drive means that has just been described is of the "instantaneous" type. Those skilled in the art will understand however that the monthly drive means of the calendar mechanism according to the invention could also be of the "continuous" or of the "semi-instantaneous" type.

The date corrector device of the calendar mechanism of this example will now be described with reference to FIG. 4. The date corrector device can be actuated manually and is for driving the 31 wheel set in one day increments. The date corrector includes a date corrector lever 61 pivoted on an axis 65, a date control pin 63 mounted on one end of lever 61, a beak 67 returned against the ratchet toothing of the 31 wheel set by a spring 71 and finally a jumper spring 69 arranged to cooperate with the ratchet toothing of the 31 wheel set.

The operation of the elements of the date corrector device which have just been listed will now be explained. The date corrector of this example is to be actuated manually by the same multi-function coaxial corrector device (not shown) that actuates the quick month corrector. It will be clear however that numerous other manual control devices known to those skilled in the art may also be suitable for actuating the date corrector of the present invention. In particular, according to a variant of the present example, the date corrector and the quick month corrector could be actuated respectively by two distinct manual control devices.

When the person wearing the watch selects the "date corrector" function of the multi-function coaxial corrector (not shown) and manually activates the corrector button, the inner bearing surface of the control mechanism pushes the date control pin 63 in the direction of the arrow (a) (FIG. 4), which causes the lever 61 to pivot about axis 65. When lever 61 pivots in this manner, beak 67, which is fixed at one end thereof, moves along a substantially tangential trajectory to the ratchet toothing of the 31 wheel set. During its movement, beak 67 hooks one of the saw teeth of the ratchet toothing and thus advances the 31 wheel set one step lifting jumper spring 69. The forward step by the 31 wheel set has the effect of incrementing the date indication by one day. It will be noted that rack 3 of the quick month corrector remains in the rest position during the use of the date corrector. Thus, lever 29 remains in the inactive position and the date corrector is still operating, even when the 31 wheel set has reached the angular position corresponding to the indication of the first day of the next month.

Figure 5:
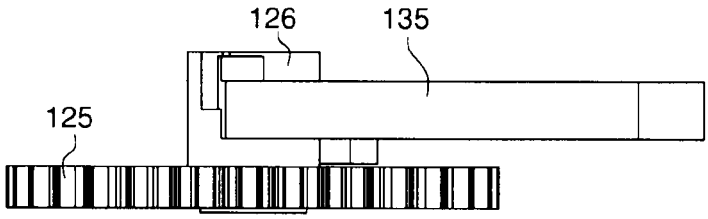
FIG. 5 is a side view of part of a quick corrector device forming part of a second embodiment of the calendar mechanism of the invention.
Figure 6:
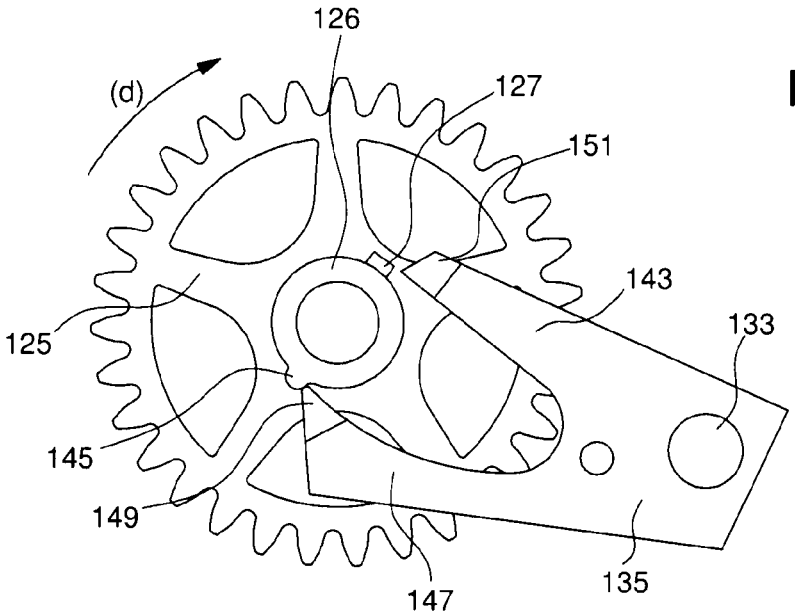
FIG. 6 is a top view of the part of a quick corrector shown in FIG. 5.
Figure 7:
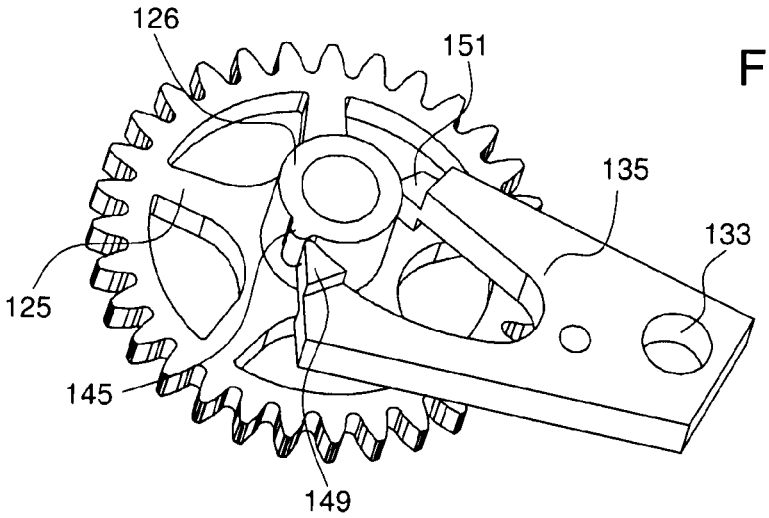
FIG. 7 is a perspective view of the part of a quick corrector shown in FIGS. 5 and 6.

FIGS. 5, 6 and 7 are respectively side, top and perspective views of one part of a quick corrector device according to a second embodiment of the invention. These three views show in particular a wheel 125 the cylindrical arbour 126 of which carries a lug 127 and a projecting portion 145. The Figures also show a fork 135 pivotally mounted about an axis 133 and one prong 147 of which plays the part of the cam follower lever, and the other prong 143 plays the part of stop lever. The function of the elements of the quick corrector which have just been listed is to stop the quick advance of the date wheel set as soon as said wheel set reaches the angular position corresponding to the indication of the first day of the month.

The other components of the quick corrector can be the same as in the first embodiment of the invention can be the same as those that have been described in relation to the first embodiment of the invention.

The operation is as follows. Wheel 125 is kinematically linked to the 31 wheel set (not shown in FIGS. 5, 6 and 7) so that that the two elements rotate at the same speed. In this example, wheel 125 is arranged to rotate clockwise (as indicated by arrow d) when the 31 wheel set is incremented. It can also be seen that, in this particular example, the lug 127 and the projecting portion 145 are shifted by around 180°. Moreover, a careful examination of the Figures also reveals that the lug and the projecting portion are not only angularly shifted about arbour 126, but they are also shifted in height. Indeed, lug 127 is placed quite low down, in immediate proximity to wheel 125, whereas the projecting portion 145 is placed higher up, close to the top end of the cylindrical arbour.

As shown in FIG. 7, the distal ends of the two prongs of fork 135 are also shifted in height. The height of the end of prong 147 corresponds to that of projecting portion 145 and the height of the end of prong 143 corresponds to that of lug 127. The end of prong 147 plays the part of a feeler spindle 149 and it is arranged to be raised by the projecting portion 145 upon each new revolution of wheel 125. As it is raised, prong 147 causes fork 135 to pivot about the axis 133 thereof. This pivoting has the effect of bringing the other prong 143 of the fork into an active position. In this position, the end 151 of prong 143 intercepts the trajectory of lug 127 so that these two elements can cooperate, the lug playing the part of rotating stop member and the end of prong 143 playing that of a stop member 151.

According to the invention, the angular position of the 31 wheel set at the moment when lug 127 encounters the end of stop lever 143 corresponds to the indication of the first day of the month. Moreover, in the example illustrated, the position at the moment when projecting portion 145 pivots fork 135 corresponds to the indication of the 27th day of the month. The Figures show the 31 wheel set one day later, in the angular position corresponding to the indication of the 28th day of the month. It can be seen that in rotating the projecting portion 145 has now gone past the feeler spindle 149. Lug 127 has not yet reached the level of stop 151. Moreover, a small spring (not shown) is arranged to return fork 135 in the direction of the arrow (d, FIG. 6). The function of the small spring is to hold the feeler spindle 149 against the surface of the cylindrical arbour 126. It can be seen in FIGS. 6 and 7 that after the passage of the projecting portion, the cam follower lever 147 and its feeler spindle are again lowered by the effect of the small spring. This movement is accompanied by a pivoting of fortes 135 about the axis 133 thereof, so that the stop lever 143 returns to the inactive position, out of the circular trajectory of lug 127.

The process that has just been described is what happens when the 31 wheel set advances step-by-step, driven by the calendar mechanism. When the 31 wheel set advances in one stroke by the action of the quick corrector device, things happen a little differently. Indeed, the rapidity of the advance of the 31 wheel set is such that the passage of projecting portion 145 causes the cam follower lever 147 to jump. Lever 147 then does not have time to fall again before lug 127 abuts against stop lever 151. It will thus be clear that the small spring arranged to return the cam follower lever against the cylindrical arbour 126 must not be too strong. One advantage of this second embodiment of the invention is that it omits the bolt (referenced 39 in FIG. 1).

It will also be clear that various alterations and/or improvements evident to those skilled in the art may be made to the embodiment described herein without departing from the scope of the present invention defined by the annexed claims. In particular, in the first embodiment, the hook 35 forming the end of the pivoting lever 26 could be replaced by a slide that can move axially between the active position and the inactive position.

What is claimed is:

1. A calendar mechanism for a timepiece, comprising:

a date wheel set to control a date indicator, the date wheel set including first teeth and being configured to be driven step-by-step by a timepiece-movement contained in the timepiece, a month wheel set including second teeth and being configured to control a month indicator, a monthly drive part to increment the month wheel set at an end of each month, the date wheel set being arranged to actuate the monthly drive part during a change from an end of one month to a first day of a next month, and a push-button and a quick corrector device arranged to be manually actuated by the push-button, the quick corrector device being configured to advance the date wheel set, independently of any particular initial angular position of the date wheel set, in one stroke of the push-button until the date indicator changes to a following month while actuating in passing the monthly drive part, wherein the quick corrector device includes a rotating stop member kinematically connected to the date wheel set, and a stop mechanism moveable between an active position in which the stop mechanism intercepts a trajectory of the rotating stop member and an inactive position, and wherein the quick corrector device is arranged to bring the stop mechanism into the active position and to advance the date wheel set in one stroke of the push-button until the stop mechanism stops the rotating stop member and immobilizes the date wheel set in an angular stop position corresponding to an indication of a first day of a month.

2. The calendar mechanism according to claim 1, wherein the quick corrector device includes a toothed sector and a single direction gear, the toothed sector being arranged to pivot in response to activation of the quick corrector device, so as to drive the date wheel set in rotation via the single direction gear.

3. The calendar mechanism according to claim 2, wherein the quick corrector device includes a single direction gear train including a ratchet wheel and a toothed wheel loose mounted coaxially to the ratchet wheel, the toothed wheel carrying a click arranged to cooperate with the ratchet in a single direction of rotation so as to form said single direction gear.

4. The calendar mechanism according to claim 1, wherein the rotating stop member is formed by a stud kinematically connected to the date wheel set and mounted in an off-center position on a rotating support, and wherein the stop mechanism is formed by a hook which is movable between an active position in which the hook intercepts a trajectory of the stud and an inactive position, the hook being arranged to be brought into the active position in response to activation of the quick corrector device.

5. The calendar mechanism according to claim 4, wherein the hook is a slide which is axially moveable between the active position and the inactive position.

6. The calendar mechanism according to claim 4, wherein the hook takes the form of a lever arranged to pivot between the active position and the inactive position.

7. The calendar mechanism according to claim 6, wherein the quick corrector device includes a toothed sector and a single direction gear, the toothed sector being configured to pivot in response to activation of the quick corrector device, so as to drive the date wheel set in rotation via the single direction gear, and wherein the quick corrector device further includes a spring to return the toothed sector towards a rest position when the quick corrector device is not activated, and a bolt which is controlled by the toothed sector and arranged to hold the hook in the active position while the toothed sector is not in the rest position.

8. The calendar mechanism according to claim 4, wherein the stud is integral with the date wheel set.

9. The calendar mechanism according to claim 4, wherein the stud is integral with a wheel driven by the date wheel set.

10. The calendar mechanism according to claim 1, wherein the calendar mechanism includes a manually activated date corrector device which drives the date wheel set in one day increments.

11. The calendar mechanism according to claim 10, wherein the calendar mechanism includes the push-button arranged to actuate the date corrector device.

12. The calendar mechanism according to claim 11, wherein the push-button is further configured to actuate the quick corrector device, and wherein the calendar mechanism includes a manually activated selector arranged to selectively associate the push-button with the quick corrector device or with the date corrector device.

13. The calendar mechanism according to claim 1, wherein the monthly drive part includes an eccentric which is concentric and integral with the date wheel set, an instantaneous lever provided with a beak, an instantaneous lever spring arranged to return the lever beak against a periphery of the eccentric, and an instantaneous click pivoted on the instantaneous lever and arranged to cooperate with one of twelve teeth of the second teeth of the month wheel set, so as to drive the month wheel set in increments of one month.

* * * * *